US005747795A

United States Patent [19]

Monney

[11] Patent Number: 5,747,795

[45] Date of Patent: May 5, 1998

[54] PHOTOELECTRIC DETECTOR FOR A REGISTER CONTROL DEVICE WITHIN A ROTARY PRINTING MACHINE

[75] Inventor: Patrick Monney, Mex, Switzerland

[73] Assignee: Bobst SA, Lausanne, Switzerland

[21] Appl. No.: 643,880

[22] Filed: May 7, 1996

[30] Foreign Application Priority Data

May 8, 1995 [CH] Switzerland ..... 01304/95

[51] Int. Cl.[6] ..... G02B 6/32; G01N 21/86

[52] U.S. Cl. ..... 250/227.24; 250/559.3

[58] Field of Search ..... 250/227.24, 227.26, 250/559.29, 559.3

[56] References Cited

U.S. PATENT DOCUMENTS

| | | | |
|---|---|---|---|
| 4,329,107 | 5/1982 | Kapany et al. | 250/227.24 |
| 4,745,288 | 5/1988 | Hurley et al. . | |
| 5,126,578 | 6/1992 | Roch et al. . | |
| 5,215,011 | 6/1993 | Monney . | |
| 5,329,466 | 7/1994 | Monney . | |

FOREIGN PATENT DOCUMENTS

| | | |
|---|---|---|
| 0 289 185 | 11/1988 | European Pat. Off. . |
| 0 473 429 | 3/1992 | European Pat. Off. . |
| 2 565 216 | 12/1985 | France . |
| 29 13 410 | 10/1980 | Germany . |
| 680 117 | 6/1992 | Switzerland . |

*Primary Examiner*—Edward P. Westin
*Assistant Examiner*—Kevin Pyo
*Attorney, Agent, or Firm*—Hill, Steadman & Simpson

[57] ABSTRACT

A detector comprises a row of scanning devices arranged in front of a web to extend transverse to the direction of movement of the web. Each device includes one or two optical illumination fibers associated with a single optical scanning fiber that leads the reflective light toward a photodiode belonging to a row situated at a remote position in the machine. Each of the optical scanning fibers is held in rigid optical relation with an associated spherical or semi-spherical lens by means of an optical glue.

12 Claims, 2 Drawing Sheets

PHOTOELECTRIC DETECTOR FOR A REGISTER CONTROL DEVICE WITHIN A ROTARY PRINTING MACHINE

BACKGROUND OF THE INVENTION

The present invention is directed to a photoelectric detector for a register control device for use in a rotary printing machine having a travelling web and a series of printing stations.

The register control device allows for automatically correcting the position of the web and/or printing cylinder of each color station according to a register error calculated from the detection of the relative positions of the register marks which are successively printed by each station in a reserved area.

A control device appreciated by its ratio of performance and reasonable cost is based on two photoelectric detectors, each of them formed of two rows of photodiodes. Such a device is disclosed in U.S. Pat. No. 5,329,466, whose disclosure is incorporated herein by reference thereto and which claims priority from Swiss Application 03318/91-5. The two parallel detectors are arranged crosswise or transverse to the travelling direction of the web above an area where the register marks are travelling, i.e., in the margin of the web. A first advantage of this device is that it is able to work with a micro register mark, for example marks of about 1 $mm^2$, and by the fact that one row consists of about twenty photodiodes with a surface reduced to approximately 0.7 $mm^2$ arranged every millimeter.

Another advantage of this device is that it is able to work with register marks printed side-by-side, as well as with consecutive register marks, even in a simple version comprising only two rows of photodiodes. In the first case with marks, which are arranged side-by-side, the rows of detectors are divided into two sidewise halves, the first row measuring the position of the travelling mark in order to determine the sidewise misregistration and the second row measuring the temporary displacement of the travelling mark in order to determine the lengthwise misregistration. In the second case of consecutive marks, a row of detectors measures the position of the travelling mark, then, after reinitialization, the position of the following travelling mark in order to determine the sidewise register error and the two rows of detectors, which are spaced at a distance corresponding to the expected lengthwise margin between the two marks, measures a temporary displacement of the travelling marks normally simultaneously.

Working satisfactorily, it turns out, however, that the photodiodes of the row comprise an electrical device which requires a whole scanning head which has to be in a solid and tight housing, respecting the standard constraints of the industrial environment. These housings are then necessarily large, so the positioning of the housings would be prevented if the printing groups of each station are too close relative to one another or if a double scanning of the front and back side of the web is necessary.

U.S. Pat. No. 5,126,578, which claims priority from the same Swiss Application resulting in Swiss Patent 680 117, and U.S. Pat. No. 5,215,011, both U.S. Pats. having their disclosures incorporated herein by reference thereto, disclose registry control devices in which each scanning device of a mark consists of a pair of beams of optical fibers of 0.2 mm in diameter. One optical fiber is a source of light with a beam travelling therein and the other optical fiber receives the reflected light and takes it to a photodiode situated far behind the machine. However, the cone of input and of output of the light in an optical fiber is approximately 60°, and the light spots and the area of the scanning correspond to a circle of a usual diameter of 4 mm. Being completely adequate for standard marks, for example rectangular marks of 1 mm by 5 mm, these scanning devices become inadequate for micro-marks reduced to a 1 mm by 1 mm pattern. As a matter of fact, the variation of the highest light intensity anticipated is then reduced to a quarter and becomes lower in the case of micro-marks of a pale color.

SUMMARY OF THE INVENTION

An object of the present invention is a photoelectric detector for a register control device comprising a row of scanning devices of marks arranged in front of a web and transverse to the travelling direction of the web. This detector has to be, at first, sufficiently small to permit the installation at any place of the machine, while being sufficiently precise to register in a reliable manner the marks of small dimensions of about 1 mm. Obviously, this detector has to be sufficiently rigid as well to support the constraints of heat and of vibrations of the machine and has to be realized in an easy manner to reduce the cost of manufacture.

These objects are achieved owing to the fact that each scanning device comprises a single optical fiber for scanning, which is coupled to a proper device or means for focusing the image by a glue of an optical quality, with each fiber carrying the reflected light to a corresponding photodetector located in the machine and at a distance from the web.

According to a first advantageous realization, each device or means for focusing the image is a spherical lens mounted against a base plate disposed in a corresponding box or recess which is a part of a row of boxes or recesses provided within the housing arranged in the vicinity of the web. The extremity of the corresponding single optical fiber for scanning is aligned on the bottom of the box or recess and the space of the box or recess between the spherical lens and the fiber is filled by a block of glue of optical quality.

The term "glue of optical quality" is understood as a glue which, after having hardened, becomes transparent and has an index of refraction rigorously homogeneous in its whole mass. The glue and the spherical lens are easily available on the market and the block of glue formed with the lens forms a rigid objective which provides a very precise field of vision.

Even if the use of the spherical lens is certainly known in the field of optical fibers, it is, however, generally limited to fiber optical connections, i.e., the linking-up of light beams. Moreover, within such connections, the extremity of the optical fiber is usually pressed directly against the spherical lens by a mechanical elastic means which supports hardly the constraints of the industrial environment, notably the vibrations.

Advantageously, the refractive index of the block of glue is the refractive index of the spherical lens. Then, the luminous rays are not refracted at the interface between the spherical lens and the block of glue, which will noticeably simplify the calculation of the focal distance in order to turn the whole frontal surface of the spherical lens to account for transmission of a maximum reflected light.

Alternatively, the space of the box between the spherical lens and the front protective glass of the row of boxes is taken by the block of glue of optical quality as well. The refractive index of the spherical lens is, thus, greater than the refractive index of the glue. Even in calculating the optical travel of the light, the realization mode is easier, notably by the use of a glue which, in the liquid state, is sufficiently fluid to take the shape of the lens by capillarity.

According to a second form of realization, each device or means for focusing the image is a lens perceptively semi-spherical of a row disposed or inserted against the external side of a front glass closing a row of recesses or boxes in a housing arranged in front of the web. For each corresponding recess, on the bottom of the recess, the extremity of the corresponding single or separate optical fiber for scanning is aligned and is taken by a block of glue.

In a useful manner, the distance between the spherical or semi-spherical lens and the web, as well as the distance between the spherical lenses and their separate optical fibers of scanning, are established in such a way that the area of scanning is a circle of radius included between 0.8 mm and 1.5 mm and the clearness of the scanning area are progressively indistinct on the periphery of the circle. In combination, the recesses with the internal width being equal to the common diameter of the spherical lens have such an external width that, after being coupled in order to form a row behind a protective glass of a housing, the scanning area overlaps on a predetermined width. Like this, a mark travelling between two areas is detected as well in a reliable manner.

Advantageously, only one or two optical fibers for lighting are coupled to each scanning device and, preferably, are arranged close to the corresponding recess for focusing the image.

Other advantages and features of the invention will be readily apparent from the following description of the preferred embodiments, the drawings and claims.

DESCRIPTION OF THE PREFERRED EMBODIMENTS

Figure 1:
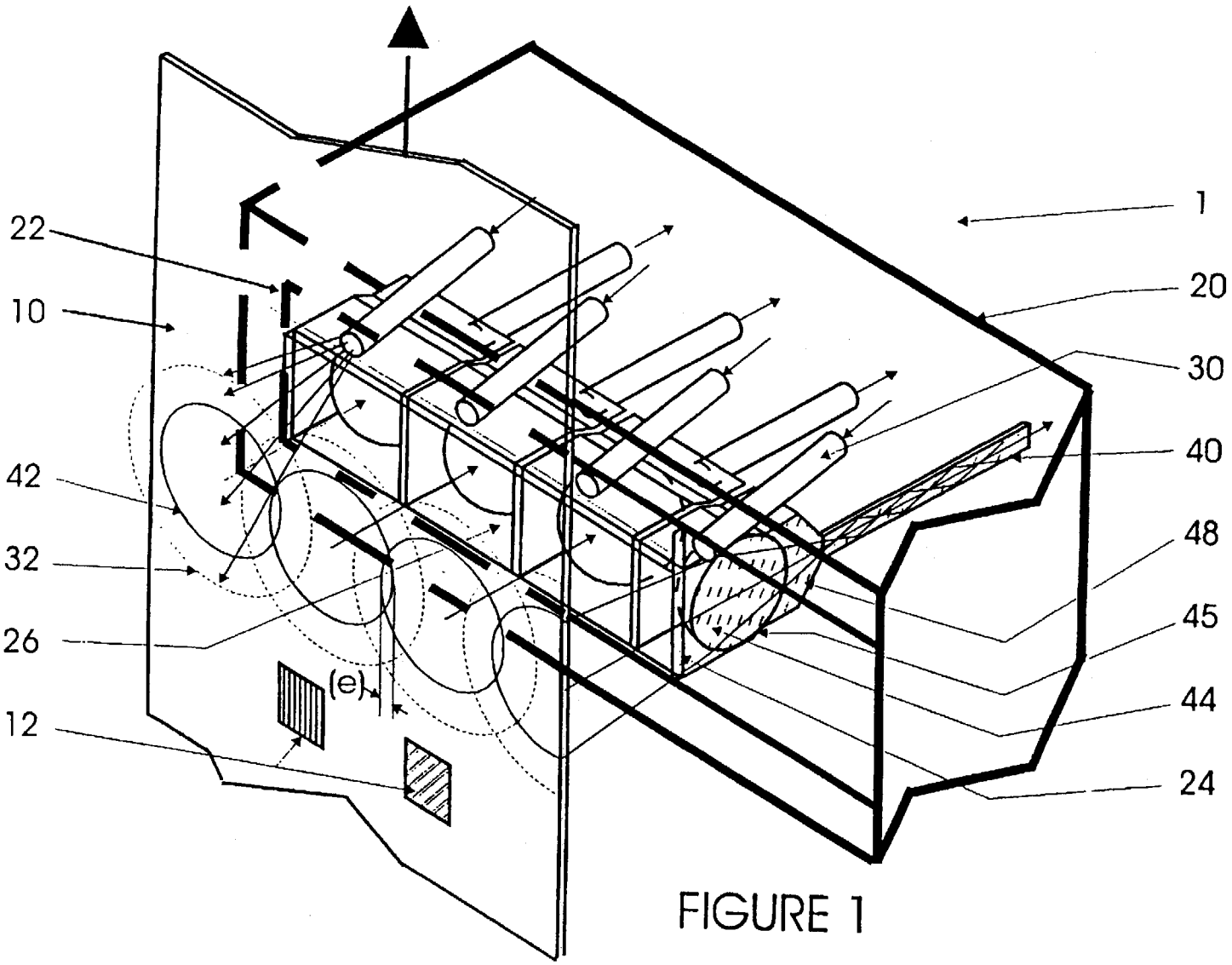
FIG. 1 is a perspective view partially exploded of a first realization mode for the invention.

The principles of the present invention are particularly useful when incorporated in a photoelectric scanning head, generally indicated at 1, which is arranged with regard to the travelling web 10 in order to scan the position of the register marks 12 printed successively by the station of the preceding color, which are arranged side-by-side or consecutively.

The scanning head 1 consists of a housing 20 with a rectangular front side, with a window 22 which is provided or equipped with a protective glass 24. Behind the glass 24 in a transverse row of scanning devices or means for the mark is installed and each device comprises a pair of optical fibers, with an upper fiber 30 for projecting light onto the web and scanning optical fibers 40, also called receptive optical fibers. The dimensions of the housing 1 are about 3 mm to 5 mm high and 20 mm to 40 mm wide, respectively, for a row of 16 or 32 scanning devices.

Light from a light source situated behind the machine is injected into the optical fibers 30 and is projected onto the web 10 at the level of the scanning head in a cone having an angle of approximately 60° in order to create each light spot 32 of a diameter comprising between 2 mm and 3 mm. The light spots of the upper row of the optical fibers 30 for lighting overlap in order to form practically a light bar across the web.

More particularly, according to the invention and as better visualized on the lengthwise section of the part of FIG. 1, the extremity of each scanning optical fiber 40 is aligned in the central part of the bottom of a back wall of a box or recess 26. This back wall has a conical form converging to the fiber. Each recess 26 has a shape of a rectangular prism with a shoulder located in the middle of its upper and lower faces, and these shoulders form a base stop 45 of a precise position for a spherical lens 44. The spherical lens 44 is kept in position by a block of glue 48 filling all of the interior space of the recess 26 between the end of the fiber 40 and the spherical lens. As illustrated in FIG. 1, the recesses or boxes 26 are glued side-by-side in order to form a rigid row of photoelectric scanning elements arranged at rigidly regular intervals.

The glue forming the block 48 is of an optical quality, for example, after having hardened, it becomes absolutely transparent with an index of refraction homogeneous and isotropic in its whole volume. An example of such a glue is marketed under the commercial name "Epotek" by the Swiss society Abatec under the reference 1103. The first function of the block of glue 48 adherent against the back wall of the box 26 is to hold the spherical lens on the base 45 and, on the other hand, the end or extremity of the scanning optical fiber 40 on the back of the recess 26. Therefore, it keeps the end of the fiber at a rigorous and predetermined distance from the spherical lens 44. The second function of this block of glue is to coact with the spherical lens 44 to form an optical eye for the reception of the reflected light coming strictly from a scanning area 42 of a rigorously predetermined dimension.

Preferably, the refractive index of the block 48 is then practically equal to the refractive index of the spherical lens 44, or about 1.5, so that the light rays will not be deviated at the interface between the sphere and block. The spacing of the scanning optical fiber 40 and the spherical lens 44, as well as the spacing of the scanning head 1 and the web 10, are then established with regard to the transverse spacing of the spherical lenses 44 within their row in such a way that the scanning areas 42 would be formed of a transverse row of circles of a diameter comprising between 0.8 mm and 1.5 mm overlapping sidewise in an area with a width e of between 0.1 mm and 0.3 mm, and this overlapping is with a small tolerance of error. Moreover, the distances mentioned before are established in such a way that the clearness of the scanning area 42, which is progressively indistinct on the periphery of the circle, in such a way that the overlapping areas of width e would be scanned for a half by one fiber and for a half by the other adjacent fiber.

To realize such a detector, the fibers are glued in a first piece having a bore located in a good and desired spacing. Then, on this first piece, a second piece, which has bores or passages which are used to hold the spherical lens in place, is positioned and, finally, optical glue is injected within a crease or space arranged between the first and second pieces in such a way as to fasten the two pieces together.

Figure 2:
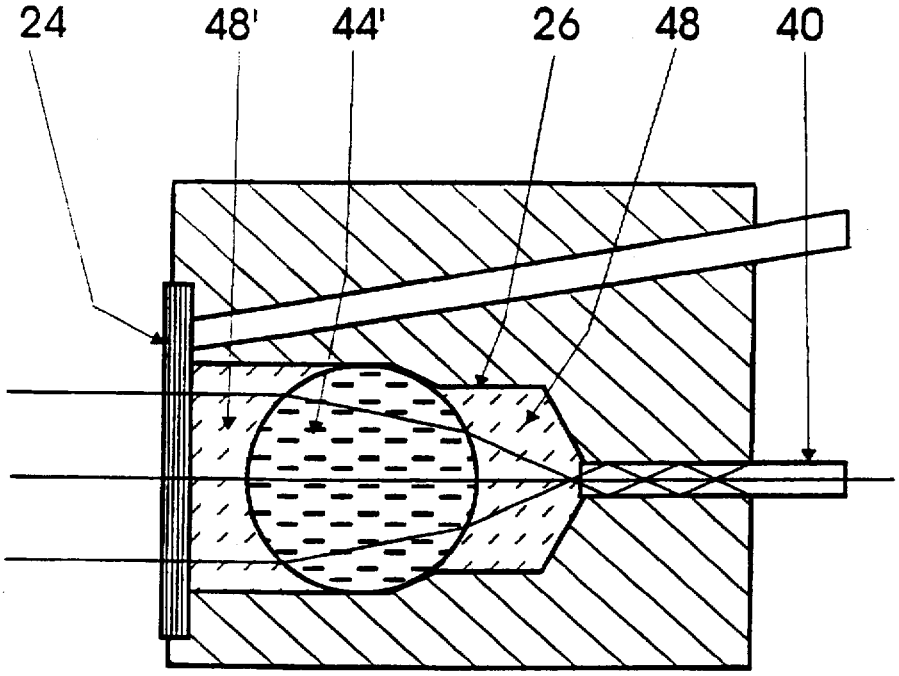
FIG. 2 is a longitudinal cross sectional view of an alternative modification of the arrangement of FIG. 1.
Figure 3:
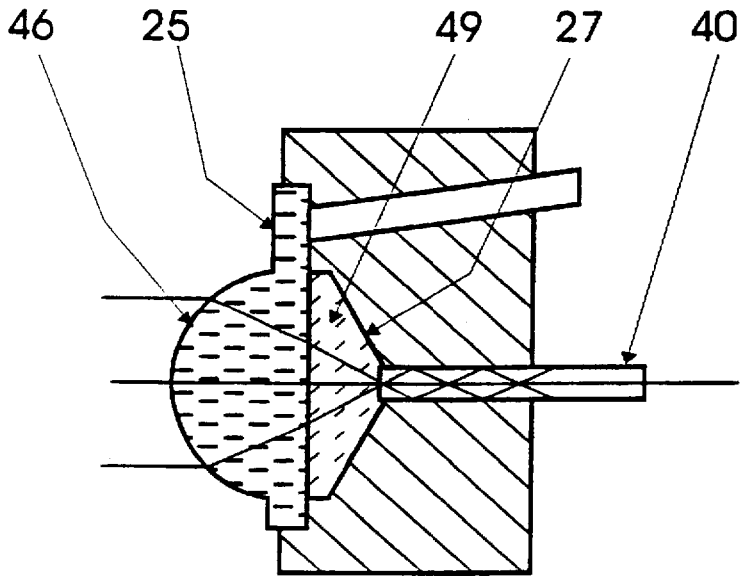
FIG. 3 is a longitudinal cross sectional view of a second modification of the arrangement of FIG. 1.

Alternatively, and as illustrated in FIG. 2, the hole or recess 26 is filled with glue surrounding the spherical lens 44' between the back block 48 in touch, like before, with the end of the back wall and the scanning optical fiber 40, and a front block 48', which is in contact with the protective glass 24. In this case, the refractive index of the spherical lens 44' is greater than the refractive index for the glue. For example, the lens has a refractive index of 1.80, whereas the glue is approximately 1.5. This alternative is then even more rigid than the first example, because the protective glass 24 is held solid with respect to the lenses 44'.

The realization of this alternative is made easier insofar as, when injecting a very fluid glue, the glue is going to flow around the surface of the spherical lens by capillarity and will fill the space between the glass 24 and lens 44'.

According to a second modification, a row of lenses 46, perceptively semi-spherical, are disposed on the external surface of the protective glass plate or member 25. A semi-spherical lens is understood as a lens which has only one of the sides as a portion of a sphere and the other side is a flat plane. The lenses could be molded with the protective glass or machined from a glass which is thicker, or simply glued individually on an exterior surface of the protective glass. The length of the bore or recess 27 is then reduced to the value of the spacing between the extremity of the end of the optical fiber 40 aligned on the back of the lens 46. This recess is then filled up, as before, with a block of glue 49, which holds the lens and glass member relative to the end of the fiber 40.

As has been described hereinabove, these scanning devices are composed of passive elements to be seen as optical fibers coupled to spherical or semi-spherical lenses through a block of glue. The devices could be installed in a row in a very rigid manner in a housing 20, which can have very small dimensions and is susceptible to be installed at any place for a rotating printing machine.

Moreover, the plurality of recesses could be molded together with the housing, and this in very accurate dimensions notable for the base stops of each spherical lens. Nevertheless, the rigorous dimensions have to be respected, and these photoelectric detectors turn out to be easy to realize as well.

Although various minor modifications may be suggested by those versed in the art, it should be understood that I wish to embody within the scope of the patent granted hereon all such modifications as reasonably and properly come within the scope of my contribution to the art.

I claim:

1. In a photoelectric detector for a register control device within a rotary printing machine for a web, said detector comprising a row of scanning devices arranged in front of the web transverse to the travelling direction for scanning marks on the web, the improvements comprising each scanning device comprising a separate optical scanning fiber and means for focusing an image, each scanning fiber receiving light and transmitting it to a corresponding photodiode situated in the machine, each means for focusing the image being a spherical lens mounted on a base stop located in a corresponding recess in a row of recesses within a housing arranged in the vicinity of the web, each recess having a bottom with the end of the corresponding optical fiber aligned therewith, and a space of the recess extending between the lens and the end of the fiber being filled by a block of glue of optical quality to couple the lens to the end of the fiber.

2. In a photoelectric detector according to claim 1, wherein the refractive index of the block of glue is perceptively equal to the refractive index of the spherical lens.

3. In a photoelectric detector according to claim 1, wherein the space of the recess extending between the surface of the spherical lens and a front protective glass member for the row of recesses is filled with a block of glue of an optical quality, the refractive index of the spherical lens being superior to the refractive index of the blocks of glue.

4. In a photoelectric detector according to claim 1, wherein the distance between each of the spherical lenses and the web, as well as the distance between the spherical lens and the end of the optical scanning fiber, is selected so that a circular scanning zone becomes progressively blurred on a periphery of the zone.

5. In a photoelectric detector according to claim 4, wherein each of the recesses has an internal width equal to the common diameter of the spherical lens to form a row with the scanning zones overlapping a predetermined width e.

6. In a photoelectric detector according to claim 1, which includes at least one optical illumination fiber for each of the scanning devices being disposed in the proximity to the corresponding image focusing means.

7. In a photoelectric detector according to claim 1, wherein each scanning device includes an optical illumination fiber being disposed in the proximity of the corresponding image focusing means.

8. In a photoelectric detector for a register control device within a rotary printing machine for a web, said detector comprising a row of scanning devices arranged in front of the web transverse to the travelling direction for scanning marks on the web, the improvements comprising a housing with a row of recesses, a front glass member for closing each recess of the row of recesses, each scanning device comprising a separate optical scanning fiber and means for focusing an image, each scanning fiber receiving light and transmitting it to a corresponding photodiode situated in the machine, each means for focusing being a semi-spherical lens on an external surface of the front glass member facing a surface of the web, each recess receiving an end of a corresponding optical fiber and being filled with a block of optical glue extending between the end of the respective optical scanning fiber and the front glass member to couple the fiber to the means for focusing.

9. In a photoelectric detector according to claim 8, wherein the distance between the semi-spherical lens and the web, as well as the distance between the end of the scanning fiber, is established so that a circular scanning zone becomes progressively blurred on a periphery of the zone.

10. In a photoelectric detector according to claim 9, wherein the semi-spherical lens has an external width so that a row of said semi-spherical lenses, the scanning zones overlap a predetermined width e.

11. In a photoelectric detector according to claim 8, wherein an optical illumination fiber is associated with each scanning device and is disposed in the proximity of the image focusing means.

12. In a photoelectric detector according to claim 8, wherein each scanning device includes an optical illumination fiber being disposed in the proximity of the corresponding image focusing means.

* * * * *